US007469547B2

(12) United States Patent
Cook

(10) Patent No.: US 7,469,547 B2
(45) Date of Patent: Dec. 30, 2008

(54) ARRANGEMENT FOR DETECTING THE POSITION OF A DAMPER BLADE USING A WIRELESS COMMUNICATION SENSOR

(75) Inventor: Matthew D. Cook, Lake Villa, IL (US)

(73) Assignee: Siemens Building Technologies, Inc., Buffalo Grove, IL (US)

( * ) Notice: Subject to any disclaimer, the term of this patent is extended or adjusted under 35 U.S.C. 154(b) by 524 days.

(21) Appl. No.: 11/192,587

(22) Filed: Jul. 29, 2005

(65) Prior Publication Data

US 2006/0048525 A1 Mar. 9, 2006

Related U.S. Application Data

(60) Provisional application No. 60/608,268, filed on Sep. 9, 2004.

(51) Int. Cl.
*F25B 49/00* (2006.01)
*G05D 23/00* (2006.01)
*G01R 27/28* (2006.01)

(52) U.S. Cl. ..... 62/131; 236/51; 324/650

(58) Field of Classification Search ..... 62/131, 62/186; 236/51, 49.3, 49.5, 68 C; 454/369, 454/342, 239, 256; 73/861.74; 624/660, 624/650, 649, 652, 674, 681
See application file for complete search history.

(56) References Cited

U.S. PATENT DOCUMENTS 6,431,203 B1 8/2002 Zhu et al.
6,447,393 B1 9/2002 McCabe
6,557,574 B2 * 5/2003 Federspiel ..... 137/12
6,581,847 B2 6/2003 Kline et al.
2001/0055947 A1 12/2001 McCabe
2003/0030299 A1 2/2003 Cleland et al.
2003/0159697 A1 * 8/2003 Wallace ..... 128/204.26
2003/0178964 A1 9/2003 Challoner
2004/0088082 A1 * 5/2004 Ahmed ..... 700/276
2004/0154397 A1 8/2004 Platt et al.
2004/0176887 A1 9/2004 Kent et al.
2004/0194327 A1 10/2004 Bryan
2004/0202344 A1 * 10/2004 Anjanappa et al. ..... 381/364

OTHER PUBLICATIONS

"Wireless Measurement and Control of the Indoor Environment in Buildings", Center for the Built Environment, © 2002, The Regents of the University of California, (2 pages).
"Agogino, Alice, Jessica Granderson, Johnnie Kim, Yao-Jung Wen, and Rebekah Yozell-Epstein, MEMS' Smart Dust Motes' for Designing, Monitoring & Enabling Efficient Lighting" MICRO Project Industry Sponsor General Electric Company; Global Research Center, GE Global Research, (44 pages), Mar. 27, 2003.

(Continued)

*Primary Examiner*—Chen-Wen Jiang

(57) ABSTRACT

A damper assembly includes a damper frame, at least one damper blade, an actuator and a sensor module. The damper blade(s) is/are movably attached to the damper frame to at least partially regulate air flow proximate the damper frame. The actuator is configured to control a position of the at least one damper blade. The sensor module is coupled to a first damper blade and includes a sensor device operable to determine position information regarding the position of the damper blade. The sensor module further includes a wireless communication circuit that is operable to communicate the position information to a second wireless communication circuit disposed off of or away from the damper blade.

20 Claims, 4 Drawing Sheets

OTHER PUBLICATIONS

Sandhu, Jaspal S., Alice M. Agogino, and Adrian K. Agogino, "Wireless Sensor Networks for Commercial Lighting Control: Decision Making with Multi-agent Systems", © 2004, American Association for Artificial Intelligence, (5 pages).

Goldman, Alex and Ken Crawford, "Tutorials", Wi-Fi-Planet Marketplace, © 2004, Jupitermedia Corporation, (12 pages).

* cited by examiner

ARRANGEMENT FOR DETECTING THE POSITION OF A DAMPER BLADE USING A WIRELESS COMMUNICATION SENSOR

This application claims the benefit of U.S. Provisional Patent Application Ser. No. 60/608,268, filed Sep. 9, 2004, and which is incorporated herein by reference.

FIELD OF THE INVENTION

The present invention relates to damper blades used for controlling air flow, and more particularly, the devices that detect the position of a damper blade.

BACKGROUND OF THE INVENTION

Ventilation dampers are devices that are used, by way of example, to control the flow of air into ventilation ducts, rooms, or other spaces of a building or facility. For example, a ventilation damper may help control the flow of cool air in to a room. In another example, a ventilation damper may control the amount of exhaust air from a building that is recirculated into the fresh air. Ventilation dampers are movable such that they may be further opened or closed in order to increase or decrease, respectively, the flow of air through the damper assembly device. In building control systems, damper assembly devices are also known as variable-air-volume (VAV) diffusers or VAV units.

One example of a VAV unit and its operation is set forth in U.S. Pat. No. 6,581,847, which is incorporated herein by reference. The VAV unit of U.S. Pat. No. 6,581,847 teaches the control of room temperature using a VAV unit to vary the volume of supply air discharged into a room. The supply air is heated when the VAV unit is in a heating mode and is cooled when the system is in cooling mode. The supply air is usually provided at substantially a constant temperature in each mode. A VAV unit regulates the volume of heated or cooled supply air in order to achieve and maintain a desired room air temperature. To this end, a controlled actuator device operates to open or close a set of louvers or ventilation dampers to increase or decrease to flow of supplied air.

Typical controlled actuator devices include thermally-powered actuators, pneumatically-powered actuators, and electrically powered actuators. All three types of actuators are coupled to the ventilation dampers by a mechanical linkage, gear assembly levers and/or combinations of these and other mechanical couplings. The actuator performs controlled movements which are translated by the mechanical couplings to changes in the positions of the dampers.

Control units for VAV units preferably maintain accurate information regarding the current position of the dampers. Accurate position information is useful for various reasons, including effective control and reliability. Inaccurate position information can even result in damage to a VAV unit. In one example, if a damper is fully open, and the position information indicates that the damper is not fully open, then the control mechanism may attempt to further open the damper. The attempt to further open the damper that is fully open is both inefficient and potentially harmful to the equipment.

Current VAV units employ various methods to maintain position information of dampers. One method is to derive the damper position from position information relating to the actuator device or the mechanical coupling. For example, in a VAV unit that includes drive gears that move mechanical linkages attached to the damper, the rotational position of the drive gear may be correlated to the position of the damper blades themselves.

The types of damper position measurements that are currently used cannot always reliably produce the level of accuracy that is necessary for high quality performance of control systems. To address this issue, those in the field have employed calibration techniques to improve the accuracy of various position methods. However, calibration techniques only provide limited improvement. Moreover, some degradation of accuracy can occur over time due to the nature of mechanical linkages, thereby reducing the effectiveness of the initial calibration.

Other methods include the use of limit switches on the damper blade itself. However, limit switches can provide little information regarding the position of the blades.

Accordingly, there is a need for improved accuracy in position measurements for use in damper or louver arrangements.

SUMMARY

The present invention addresses the above-described needs, as well as others, by providing a sensor module coupled directly to the damper blade. Preferably, the sensor module includes wireless communication capabilities. Use of a sensor module that is directly coupled to the damper blade removes inaccuracies due to the indirect measurement techniques of the prior art. The sensor module is preferably calibrated prior to use, but in some cases may be used with little or no calibration.

A first embodiment of the invention is a damper assembly that includes a damper frame, at least one damper blade, an actuator and a sensor module. The damper blade(s) is/are movably attached to the damper frame to at least partially regulate air flow proximate the damper frame. The actuator is configured to control a position of the at least one damper blade. The sensor module is coupled to a first damper blade and includes a sensor device operable to determine position information regarding the position of the damper blade. The sensor module further includes a wireless communication circuit that is operable to communicate the position information to a second wireless communication circuit disposed off of or away from the damper blade.

A second embodiment is an arrangement for use in a damper assembly, the damper assembly configured to regulate the flow of air in the vicinity of the damper assembly. The arrangement includes a sensor module having a sensor device and a wireless communication circuit. The sensor module is coupled a first movable damper blade of the damper assembly. The sensor device is operable to determine position information regarding the position of the damper blade. The wireless communication circuit is operable to communicate the position information to a second wireless communication circuit disposed off of the damper blade.

The above described features and advantages, as well as others, will become more readily apparent to those of ordinary skill in the art by reference to the following detailed description and accompanying drawings.

DETAILED DESCRIPTION

Figure 1:
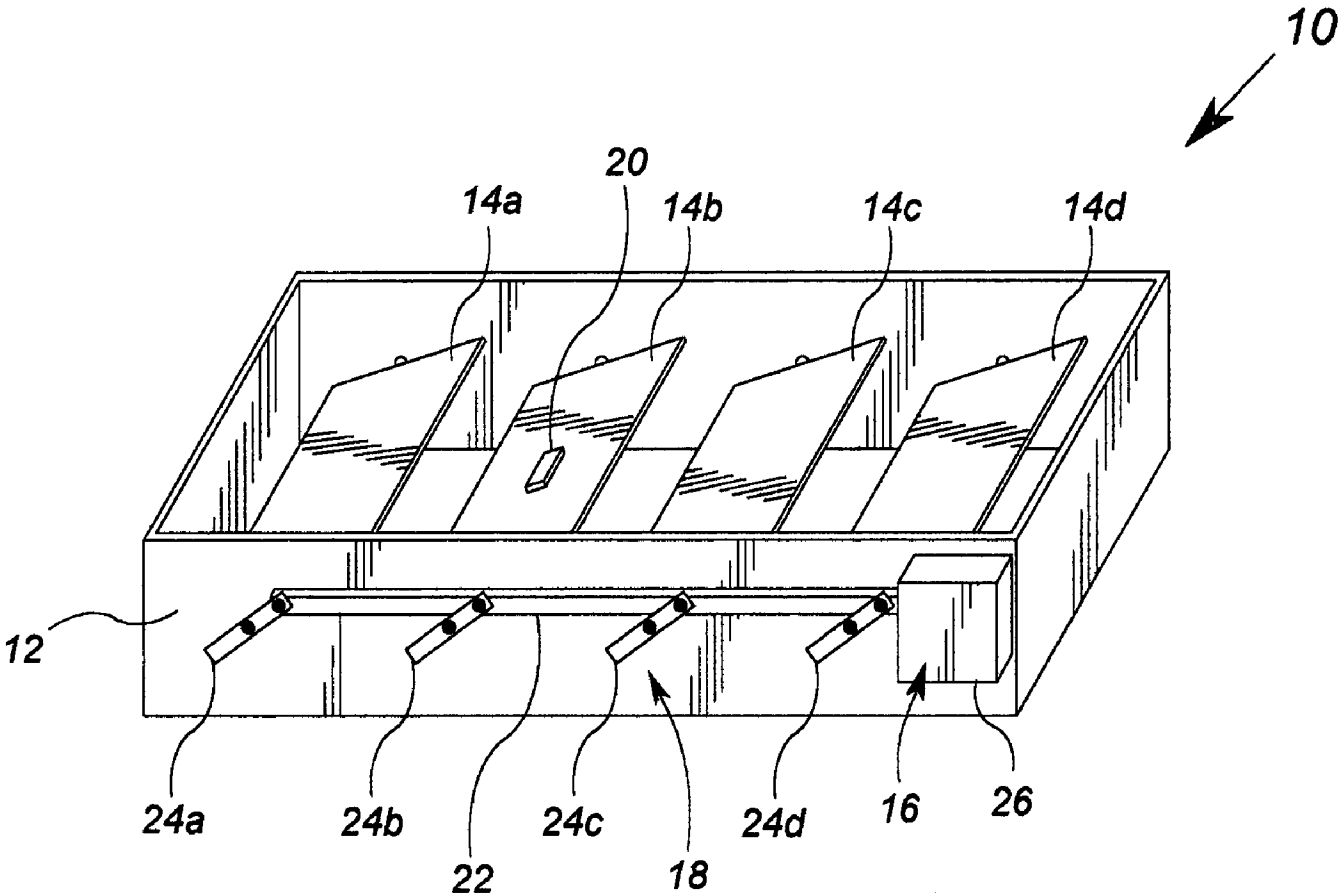
FIG. 1 shows a perspective view of an exemplary damper assembly according to the present invention.
Figure 2:
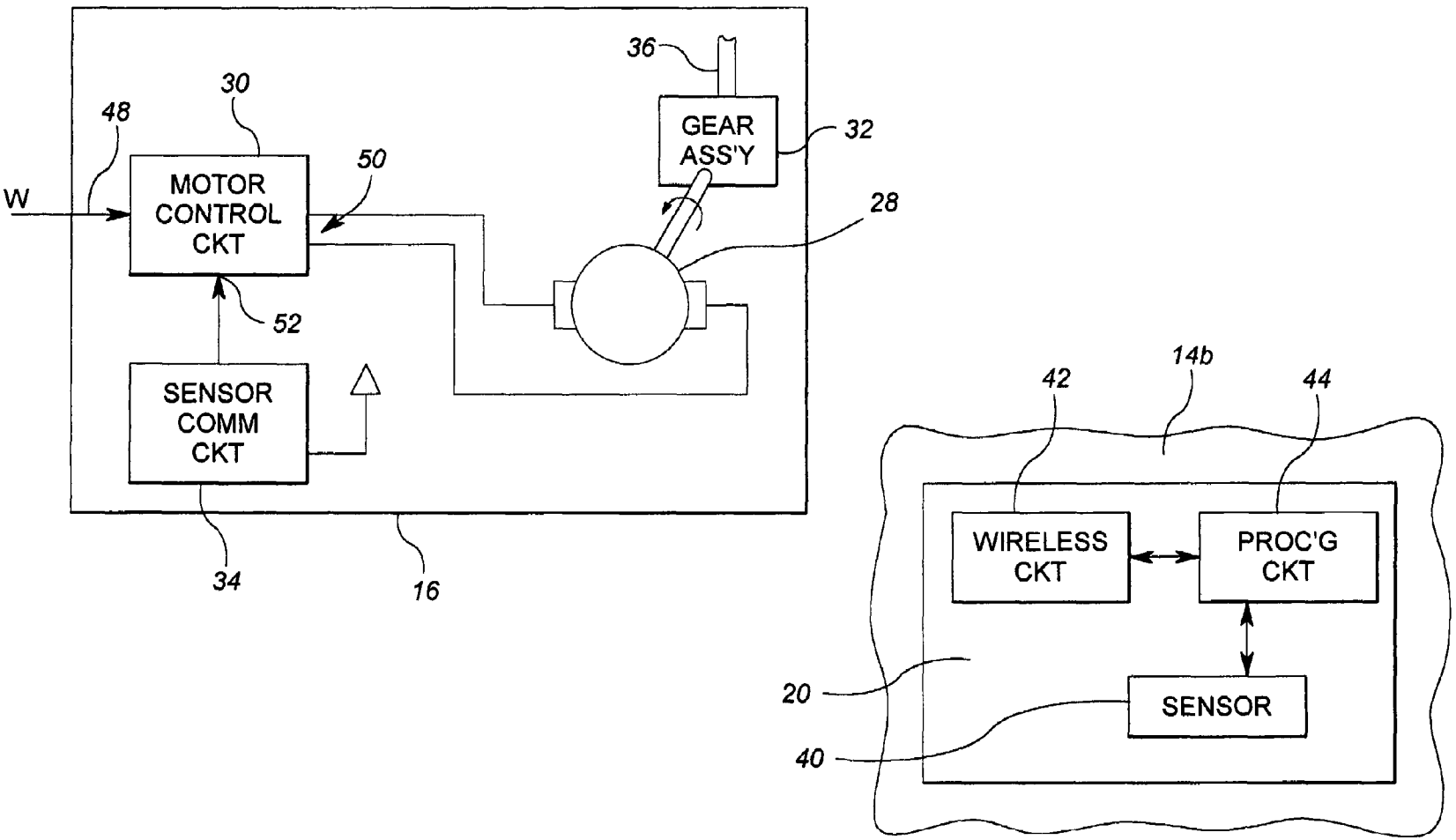
FIG. 2 shows a schematic block diagram of pertinent electrical components of the damper assembly of FIG. 1.

FIG. 1 shows a perspective view of an exemplary damper assembly 10 according to the present invention. The electrical components of the damper assembly 10 are illustrated in FIG. 2. Reference is made simultaneously to FIGS. 1 and 2 in the ensuing description. The damper assembly 10 may be employed as a VAV unit.

The damper assembly includes a damper frame 12, a plurality of damper blades 14*a*, 14*b*, 14*c*, and 14*d*, an actuator module 16, a linkage assembly 18, and a sensor module 20. The damper frame 12 is a housing for a ventilation damper, which may suitably take the form of any housing for an HVAC ventilation damper or variable air volume ("VAV") unit. The plurality of damper blades 14*a*, 14*b*, 14*c* and 14*d* are movably attached to the damper frame 12 to at least partially regulate air flow proximate the damper frame 12. To this end, each of the damper blades 14*a*, 14*b*, 14*c* and 14*d* may rotate about its own longitudinal axis between a closed or nearly closed position and various degrees of open positions. It is noted that while four damper blades 14*a*, 14*b*, 14*c* and 14*d* are shown in the example of FIG. 1, other embodiments may employ as few as one damper blade and as many damper blades as is practicable.

The actuator module 16 is an assembly that operates to cause movement of the damper blades 14*a*, 14*b*, 14*c* and 14*d*. More specifically, the actuator module 16 has a mechanical output operably connected to the linkage assembly 18 to cause controlled movement thereof. The actuator 16 is preferably affixed to a portion of the damper frame 12.

The linkage assembly 18 is configured to, when moved by the actuator module 16, rotate the damper blades 14*a*, 14*b*, 14*c* and 14*d*. Various types of linkage assemblies that translate actuator movement to rotational movement of damper blades are known and may suitably used. In the exemplary embodiment described herein, the linkage assembly 18 includes a drive rod 22 and a plurality of linking members 24*a*, 24*b*, 24*c* and 24*d*. Each of the linking members 24*a*, 24*b*, 24*c* and 24*d* are rotatably attached to the damper frame 12 and further fixedly coupled to a corresponding one of the damper blades 14*a*, 14*b*, 14*c* and 14*d*. Because the damper blades 14*a*, 14*b*, 14*c* and 14*d* are fixedly coupled to corresponding linking members 24*a*, 24*b*, 24*c* and 24*d*, rotational movement of the linking members 24*a*, 24*b*, 24*c* and 24*d* results in rotational movement of the damper blades 14*a*, 14*b*, 14*c* and 14*d*.

Referring again to the actuator module 16, the actuator module 16 in the exemplary embodiment described herein includes a housing 26 (FIG. 1) in which are contained a motor 28, a motor control circuit 30, a gear assembly 32, a sensor communication circuit 34, and an output shaft 36. (See FIG. 2) The housing 26 may suitably comprise an enclosure, or a container that is partially enclosed, which may take a variety of shapes.

Referring to FIG. 2, the motor control circuit 30 is a circuit that is operable to control the operation of the motor 28. The gear assembly 32 is coupled to the output of the motor 28 and further is coupled to the output shaft 36. The gear assembly 32 converts the output rotations of the motor 38 to the output rotations of the output shaft 36. Typically, the gear assembly 32 generates an output rotational speed that is lower than that of the motor 38 in order to provide slow, controlled movement of the output shaft 36. The output shaft 36 is operably connected to the linkage assembly 18, and more specifically, the drive rod 22.

The actuator motor 38, gear assembly 32 and output shaft 36 may take the form of any suitable actuator motor and mechanical output design. Other embodiments may employ other prime movers, such as linear displacement devices, pneumatically-powered devices, thermally-powered devices, or the like, instead of a rotating motor. Still other embodiments may use return springs that bias the output shaft 36 such that the ventilation dampers are fully open or closed in the absence of electrical power to the motor 28. Regardless of the embodiment, however, the actuator module 16 is operable to cause the drive rod 22 to move to approximately a predetermined position based on an input voltage received at the motor control circuit 30.

The sensor communication circuit 34 is operable to communicate wireless communication signals at least over the short range. For example, the sensor communication standard. As used herein, wireless communication signals are considered to include the broader definition of electrical signals radiated through the air (i.e. without the benefit of an artificial communication medium such as a transmission line), regardless of frequency or modulation type.

The sensor communication circuit 34 is operably connected to provide information to the motor control circuit 30. In particular, as will be discussed further below, the sensor communication circuit 34 is operable to provide position information regarding one or more of the damper blades 14*a*, 14*b*, 14*c* and 14*d* to the motor control circuit 30.

The sensor module 20 is a device that detects and communicates position information regarding the damper blade 14*b*. To this end the sensor module 20 is in a fixed relationship with the damper blade 14*b*. For example, the sensor module 20 is coupled direct to the damper blade 14*b* as shown in FIG. 1, or attached to a rigid fixture that is fixedly attached to the blade 14*b*.

In order to detect or obtain position information regarding the damper blade 14*b*, the sensor module 20 includes a sensor device 40 operable to determine position information regarding the position of the damper blade. (See. FIG. 2) The sensor module 20 further includes a wireless communication circuit 42 operable to communicate the position information to a wireless communication circuit disposed off of the damper blade 14*b*. In the embodiment described herein, the wireless communication circuit 42 is operable to communicate position information at least to the sensor communication circuit 34 of the actuator module 16.

In the embodiment described herein, the sensor device 40 is preferably a microelectromechanical system sensor or MEMS sensor. MEMS sensors have the advantage of requiring relatively little space and electrical power, and have relatively little mass. A MEMS position sensor can readily fit onto a small enough footprint to allow the sensor module 20 to fit onto the damper blade 14*b*.

The MEMS position sensor may suitably be a MEMS accelerometer device. A MEMS accelerometer device, as is known in the art, generates a signal representative of acceleration in a particular direction ("measurement direction"). As used herein, the MEMS accelerometer detects gravitational force when not in motion. Accordingly, different attitudes of the MEMS accelerometer device with respect to the vertical can result in different readings which depend on the coincidence of the measurement direction with the direction of the gravitation pull. The detection of different attitudes may be used to detect the position of the rotating damper blade 14*b*.

Figure 4A:
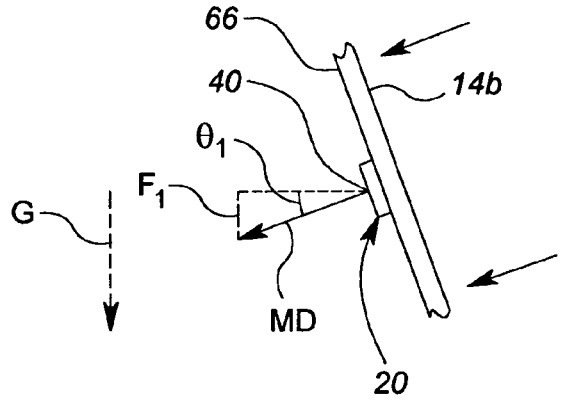
FIGS. 4A, 4B, and 4C show fragmentary representative view of a damper blade and a sensor module affixed thereto, in three different rotational positions.
Figure 4B:
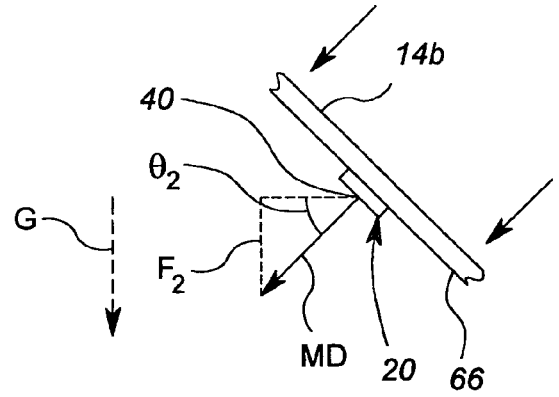
Figure 4C:
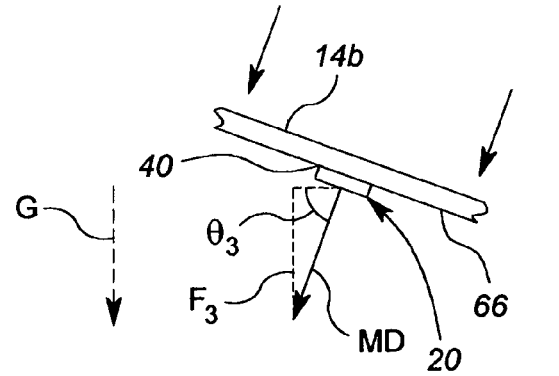

By way of illustration, FIGS. 4A, 4B and 4C each show a portion of the damper blade 14*b* and the attached sensor module 20, which includes a MEMS accelerometer device as the sensor device 40. In FIGS. 4A, 4B and 4C, the damper blade 14*b* is in a different position or attitude. FIG. 4A shows the damper blade 14*b* in a nearly vertical position, FIG. 4C shows the damper blade 14*b* in a nearly horizontal position, and FIG. 4B shows the damper blade 14*b* is a position nearly midway between the horizontal and vertical positions.

In each of the FIGS. 4A, 4B and 4C, the MEMS accelerometer sensor device 40 has a measurement direction MD that is normal to the surface 66 of the damper blade 14*b*. The measurement direction MD is the linear direction on which the MEMS accelerometer detects acceleration forces. Thus, the sensor device 40 generates a different measurement of gravitational force in FIGS. 4A, 4B and 4C even though gravitational force remains constant, because the measurement direction MD varies from the direction of gravity by differing degrees.

Referring to FIG. 4A, the measurement direction MD is at a small angle $\theta_1$ from the horizontal. Assuming the gravitational component is the vertical component G, then the MEMS accelerometer sensor device 40 can only detect a small component of G, which is given by the equation $F_1=G \sin \theta_1$. Referring to FIG. 4B, the MEMS accelerometer sensor device 40 detects a force of $F_2=G \sin \theta_2$, which is larger than $F_1$ because the angle $\theta_2$ is greater than the angle $\theta_1$. Referring to FIG. 4C, the MEMS accelerometer sensor device 40 detects a force of $F_3=G \sin \theta_3$, which is larger than $F_1$ and $F_2$ because the angle $\theta_3$ is greater than the angles $\theta_1$ and $\theta_2$.

Using these relationships between detected force and angle, it can be seen that a measurement of force F can be converted to an angle θ using the equation:

$$\theta=\arcsin(F/G)$$

The angle θ represents the angle of inclination of the damper blade 14*b* from the vertical. It is noted that as represented in FIG. 1, the damper blade 14*b* will be fully open when the angle θ is 0 degrees, and will be fully closed when the when the angle θ is 90 degrees. Thus, the angle θ may be used as a measure of the position of the damper blade 14*b*, or may be converted to a percentage value if desired.

Referring again to FIG. 2, the processing circuit 44 of the sensor module 20 is operable to convert the raw accelerometer (or other sensor) measurement of the sensor device 40 into an output value that is representative of position, such as the angle θ or a corresponding percentage value. The processing circuit 44 may also include a filtering operation that filters out any accelerometer measured force due to movement of the damper blade 14*b*. In particular, as the damper blade 14*b* is moved to further open or close the damper, some acceleration forces may be generated due to the movement itself. Such forces are suitably small, as the rotational movement of the damper blade is typically slow. However, the processing circuit 44 of the sensor module 20 may include a suitable digital filter to account for the instantaneous forces due to movement if necessary.

Figure 5:
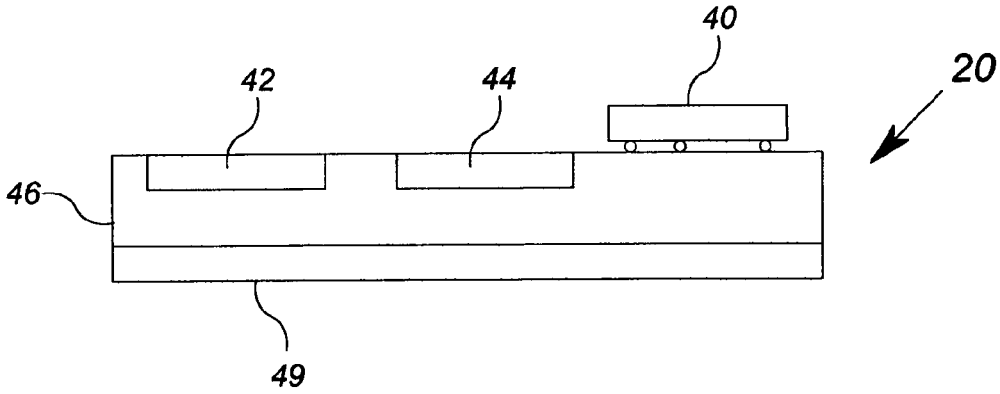
FIG. 5 shows a representative side view of an exemplary embodiment of a sensor module integrated onto a single semiconductor substrate.

Referring again generally to FIGS. 1 and 2, it is preferable if the communication circuit 42 and the processing circuit 44 are incorporated onto the same substrate as the sensor device 40. To this end, on-chip Bluetooth communication circuits are known. In addition, methods of attaching MEMS devices to semiconductor substrates is known, such as is taught in connection with FIG. 8 of U.S. patent application Ser. No. 10/951,450 filed Sep. 27, 2004 and which is incorporated herein by reference. FIG. 5 shows a side view of an exemplary sensor module 20 wherein the various components are incorporated into one chip.

It will be appreciated that some or all of the above described processing of the positioning data may be carried out elsewhere, such as in the motor control circuit 30, in order to coverup power. However, it is useful to at least include filtering in the processing circuit 44 in order to reduce the amount of data transmitted and thereby conserve power.

Referring to FIG. 5, a preferred embodiment of the sensor module 20 is a semiconductor substrate 46 having the processing circuit 44 and the communication circuit 42 formed thereon, and a MEMS sensor device 40 attached thereto, such as by flip-chip bonding. In addition, it would be advantageous to attach a power source such as a battery to the substrate 46. The battery may suitably be a lithium ion coin cell type structure 49 affixed to the side of the semiconductor substrate 46 opposite the processing circuit 44 and communication circuit 42. It will be appreciated that if a suitable communication circuit cannot be formed in the semiconductor substrate 46, it too may be separately formed and then attached via flip-chip or similar type of bonding.

Referring again to FIGS. 1 and 2, the damper assembly 10 is intended to provide accurate positioning of the damper blades 14*a*, 14*b*, 14*c* and 14*d* based on an input voltage or signal w by the motor control circuit 30 of the actuator module 16. The input signal w is a set point provided by an HVAC controller or the like, not shown, which determines the degree to which the damper blades 14*a*, 14*b*, 14*c* and 14*d* should be opened. The damper blades 14*a*, 14*b*, 14*c* and 14*d* are opened or closed in order to increase or decrease, respectively, the flow of heated or chilled air into an area of a building.

Ideally, the actuator module 16 and the linkage assembly 18 cooperate to position the damper blades 14*a*, 14*b*, 14*c* and 14*d* in the position that corresponds to the input signal w. However, due to errors and/or tolerances in the elements of the linkage assembly 18 and motor amplifiers and the like, accurate positioning is not practicable without at least some feedback regarding the position of the damper blades 14*a*, 14*b*, 14*c* and 14*d*. The damper position information allows the actuator module 16 to adjust the position of the damper blades 14*a*, 14*b*, 14*c* and 14*d* to compensate for errors in the positioning operation. In accordance with the present invention, the position feedback is provided directly from at least one the damper blades 14*b*, so that the position feedback is particularly accurate. With accurate feedback, the damper blades 14*b* may be positioned more accurately and/or more rapidly with respect to the desired position as indicated by the input signal w.

Figure 3:
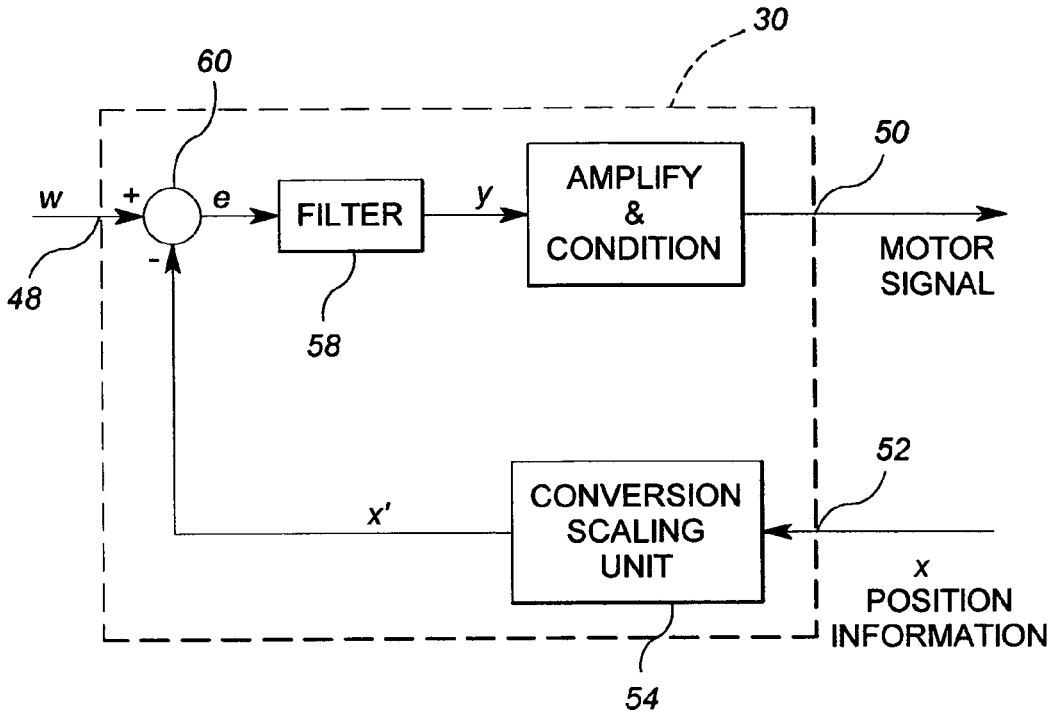
FIG. 3 shows a functional block diagram of a motor control circuit of the damper assembly of FIGS. 1 and 2.

The feedback positioning control operation discussed above is carried out by the motor control circuit 30 in the embodiment described herein. A functional block diagram of the motor control circuit 30 is shown in FIG. 3. Referring to FIG. 3, the motor control circuit 30 includes a set point input 48, a motor control signal output 50, a position information input 52, a conversion/scaling unit 54, a filter 58, a summation device 60, and an amplifying and conditioning circuit 62.

As illustrated by FIG. 2, the set point input 48 is coupled to receive the input signal w, and the motor signal output 50 is operably coupled to the motor 28. In addition, the position information input 52 is connected to the communication circuit 34. Referring again to FIG. 3, the set point input 48 is operably coupled to a positive summation input of the summation device 60. A negative summation input of the summation device 60 is operably connected to receive a current position signal x' from the position information input 52 via the conversion/scaling unit 54.

The conversion/scaling unit 54 provides any conversion necessary between the units of the feedback position information x from the input 52 and the desired damper position information employed by the input signal w. The conversion/scaling unit 54 may suitably include logic for unit conversion and conversion circuitry between analog and digital signals. The exact construction of the conversion/scaling unit 54 will depend on the formats of the position information at the two inputs 48 and 52. Those of ordinary skill in the art may readily devise a suitably conversion circuit once the format of the position information at the two inputs 48 and 52 are known. In some embodiments, the input signal w will be converted to units of the position input signal x in the motor control circuit 30 prior to being forwarded to the summation device 60. In such a case, the conversion/scaling unit 54 would be coupled between the input 48 and the summation device 60.

In any event, the output of the summation device 60 is an error signal e that represents the difference between the desired position w and the current position x'. The summation device 60 is operably connected to provide the error signal to the filter 58, which is in turn coupled to the amplifying and conditioning circuit 62. The filter 58 is a control filtering device that provides a controlled loop delay and/or dampening function using proportional, proportion integrational derivative ("PID"), or other known control signal conditioning techniques. The filter 58 provides a desired transition profile (speed and dampening) between the current position x' and the desired position w of the damper blades 14*a*, 14*b*, 14*c* and 14*d*. The output y of the filter 58 is based on the error signal e and the control function. Suitable control algorithms are known in the art.

The output of the filter 58 is connected to the amplifying and conditioning circuit 62. The amplifying and conditioning circuit 62 has the analog circuitry that converts a communicated control signal y (from the filter 58) into a motor control signal. The communicated control signal may suitably be a digital value, or an analog voltage signal, depending on the design of the control filter 58 and the format of the input signal w. In either case, the control output signal y typically is not specifically designed to control the motor 28 directly, but rather requires amplification, conditioning, and often conversion into another form. Suitable amplification and conditioning circuits are known and will vary depending on the design of the motor 28, the gear assembly 32 and linkage assembly 18. The output of the amplifying and conditioning circuit 62 is operably coupled to the motor signal output 50.

Operation of the damper assembly 10 is described in reference to FIGS. 1, 2 and 3 simultaneously. Initially, a set point signal w is provided to the actuator module 16, and in particular, to the set point input 48 of the communication circuit 42. The set point signal w in this embodiment is representative of a desired position (i.e. degree of openness or angle with respect to the horizontal or vertical) of the damper blades 14*a*, 14*b*, 14*c* and 14*d*. The motor control circuit 30 receives the input signal and generates appropriate motor control signals to place the damper blades 14*a*, 14*b*, 14*c* and 14*d*.

To this end, referring to FIG. 3, the motor control circuit 30 receives the input signal w at the summation device 60. The negative input of the summation device 60 receives the value x', which is representative of the current damper position (i.e. position of the blades 14*a*, 14*b*, 14*c* and 14*d*). The current damper position value x' is obtained from position information generated by the sensor module 20. Obtaining that position value x' is described in particular reference to FIG. 2.

Referring to FIG. 2, the sensor 40 of the sensor module 20 generates a signal representative of the rotational position of the damper blade 14*b*. As discussed above in connection with FIGS. 4A, 4B and 4C, this may be accomplished using a MEMS accelerometer that measures the component of gravitational force at the current position. The processing circuit 44 receives the position signal and generates a refined value that constitutes the position information x. To generated the refined position x, the processing circuit 44 may suitably employ analog to digital conversion, low pass filtering, and other techniques on the raw position signal. In any event, the processing circuit 44 provides the position information x to the wireless communication circuit 42.

The wireless communication circuit 42 of the sensor module 20 performs modulation, conditioning and amplification to generate a wireless position signal which is transmitted to the sensor communication circuit 34 of the actuator module 16. The sensor communication circuit 34 then provides the position information x to the position information input 52 of the motor control circuit 30.

Referring to FIG. 3, the conversion/scaling unit 54 performs conversion of the position information to generate the position information x' in appropriate units.

Thus, the summation device 60 receives the value w representative of the new desired damper position at its positive summation input and the value x' representative of the current damper position x' at its negative summation input. The output of the summation device 60, the error signal e, is a signed value representative of the amount that the damper position has to be adjusted to achieve the desired position w.

The filter 58 receives the error signal e and generates a process signal y based thereon. The process signal y constitutes the output of the control algorithm. The filter 58 provides the process signal y to the amplifying and conditioning circuit 62. The amplifying and conditioning circuit 62 generates the motor control signals to change the damper position from the present position by an amount (and direction) indicated in the process signal y. These motor control signals are provided to the motor control output 50.

Referring again generally to FIGS. 1 and 2, the motor 28 receives the motor control signals from the motor control output 50 and generates an amount of rotation, as well as direction of rotation, corresponding to the motor control signals. The gear assembly 32 converts the motor rotation to a suitable movement of the output shaft 36, which in turn, drives the drive rod 22. The movement of the drive rod 22 rotates the linking members 24*a*, 24*b*, 24*c* and 24*d* by an amount and direction corresponding to the output signal y. The linking members 24*a*, 24*b*, 24*c* and 24*d* rotate the damper blades 14*a*, 14*b*, 14*c* and 14*d* accordingly.

As the blades 14*a*, 14*b*, 14*c* and 14*d* rotate, the sensor 40 of the sensor module 20 detects the changed position information and generates a new signal. The sensor module 20 operates to provide the new position information x to the communication circuit 34 of the actuator module 16. The communication circuit 34 provides the new position information x to the position information input 52 of the motor control circuit 30.

Referring to FIG. 3, the conversion/scaling unit 54 generates the new position value x' based on the received new position information x. The conversion/scaling unit 54 provides the new value of x' to the summation device 60. The summation device 60 then generates a new error signal e based on the difference between the desired position value w and the updated position information x'. The filter 58 and amplifying and conditioning circuit 62 generate updated new motor signals based on the new error signal e.

The above described process repeats iteratively, using subsequently updated position information values x from the sensor module 20, until the error signal e is equal to, or substantially equal to, zero.

The above described embodiment provides for relatively precise positioning because the position information is provided directly from the damper blade 14*b*. By contrast, prior art devices derive position information from the gear assembly 32, motor 28 or portions of the linkage assembly 18. The prior art device's position information cannot account for error added by elements disposed between the position sensor and the damper blades. By using the measurement from the damper blade itself, the errors in the position information are substantially reduced.

It will be appreciated that in other embodiments, multiple position sensors may be employed on one or more of the blades 14*a*, 14*b*, 14*c* and 14*d*. In such a case, the position information from the various devices may be averaged or otherwise statistically processed to generate a more reliable position information value x or x'. In some embodiments, a traditional mechanical position sensor may also be employed to ensure that the sensor module 16 is working properly (e.g. if measurements of both are within a certain tolerance). The traditional mechanical position sensor may also be used as a backup in the event of failure of the sensor module 16.

In another embodiment, it may be preferable to employ another type of MEMS sensor, or even a non-MEMS sensor. In one alternative, the MEMS accelerometer sensor device 40 is able to generate gravitational force measurements in two or three linear dimensions. In such a case, the processing circuit 44 of the sensor module 20 may use the extra measurements to increase the accuracy of the position information.

It will also be appreciated that the position information x need not be communicated to the actuator module 16 directly. Another wireless communication device may receive the transmitted position information from the sensor module 20, and then forward the sensor information to the actuator module 16 by other means. In addition, other elements of the actuator module 16 may suitably be located in separate housings as opposed to within a single housing as described above. However, the embodiment of FIG. 2 provides the added advantage of providing a compact and easy to install configuration.

It will further be appreciated that the above described embodiments are merely exemplary, and that those of ordinary skill in the art may devise their own modifications and implementations that incorporate the principles of the present invention and fall within the spirit and scope thereof.

I claim:

1. A damper assembly comprising:

a damper frame;

at least one damper blade movably attached to the damper frame to at least partially regulate air flow proximate the damper frame;

an actuator configured to control a position of the at least one damper blade; and a sensor module coupled to a first of the at least one damper blade, the sensor module including a sensor device operable to determine position information regarding the position of the first damper blade, the sensor module further including a first wireless communication circuit operable to communicate the position information to a second wireless communication circuit disposed off of the first damper blade.

2. The damper assembly of claim 1, wherein the first wireless communication circuit includes an RF communication device.

3. The damper assembly of claim 1, wherein the sensor device comprises an accelerometer.

4. The damper assembly of claim 3, wherein the sensor device comprises a microelectromechanical systems accelerometer.

5. The damper assembly of claim 1, wherein the sensor device comprises a microelectromechanical systems sensor.

6. The damper assembly of claim 1, wherein the second wireless communications circuit and the actuator are fixedly secured to a common housing.

7. The damper assembly of claim 6, wherein the actuator is configured to control a position of the at least one damper blade based at least in part on the position information.

8. The damper assembly of claim 1, wherein the actuator is configured to control a position of the at least one damper blade based at least in part on the position information.

9. An arrangement for use in a damper assembly, the damper assembly configured to regulate the flow of air in the vicinity of the damper assembly, the arrangement comprising:

a sensor module coupled a first movable damper blade of the damper assembly, the sensor module including a sensor device operable to determine position information regarding the position of the damper blade, and a wireless communication circuit operable to communicate the position information to a second wireless communication circuit disposed off of the damper blade.

10. The arrangement of claim 9, wherein the wireless communication circuit includes an RF communication device.

11. The arrangement of claim 9, wherein the sensor device comprises an accelerometer.

12. The arrangement of claim 11, wherein the sensor device comprises a microelectromechanical systems accelerometer.

13. The arrangement of claim 9, wherein the sensor device comprises a microelectromechanical systems sensor.

14. The arrangement of claim 9, further comprising the actuator, and wherein the actuator is configured to control a position of the first damper blade based at least in part on the position information.

15. The arrangement of claim 9 wherein the sensor module is coupled directly to the first movable damper blade.

16. The arrangement of claim 9 wherein the sensor module further comprises at least one battery.

17. A method of controlling a position of a damper comprising:

a) providing a first signal to a control circuit, the first signal representative of a desired damper position;

b) using a device disposed on a damper blade to detect a present damper position;

c) communicating the information representative of the present damper position to the control circuit; and d) using the control circuit to cause at least one mechanical device to move responsive to the desired damper position and the information representative of present damper position.

18. The method of claim 17, wherein step c) further comprises using wireless communications to communicate the information representative of the present damper position to the control circuit.

19. The method of claim 17, wherein step d) further comprises using the control circuit to cause at least one mechanical device to move responsive to a difference between the desired damper position and the information representative of present damper position.

20. The method of claim 17 wherein step b) further comprises using a MEMS sensor disposed on a damper blade to detect a present damper position.

* * * * *